US009683560B2

(12) United States Patent
Rau

(10) Patent No.: US 9,683,560 B2
(45) Date of Patent: Jun. 20, 2017

(54) SHALLOW FLUID EXTRACTOR

(71) Applicant: Joseph Paul Rau, Fullerton, CA (US)

(72) Inventor: Joseph Paul Rau, Fullerton, CA (US)

( * ) Notice: Subject to any disclaimer, the term of this patent is extended or adjusted under 35 U.S.C. 154(b) by 0 days.

(21) Appl. No.: 14/728,851

(22) Filed: Jun. 2, 2015

(65) Prior Publication Data

US 2015/0355644 A1 Dec. 10, 2015

Related U.S. Application Data

(60) Provisional application No. 62/009,013, filed on Jun. 6, 2014.

(51) Int. Cl.

| | |
|---|---|
| ***F04B 17/06*** | (2006.01) |
| ***F04B 19/04*** | (2006.01) |
| ***F04B 23/02*** | (2006.01) |
| ***F04B 39/12*** | (2006.01) |
| ***F04B 53/16*** | (2006.01) |

(52) U.S. Cl.

CPC ..... *F04B 17/06* (2013.01); *F04B 19/04* (2013.01); *F04B 23/02* (2013.01); *F04B 39/123* (2013.01); *F04B 53/16* (2013.01); *Y10T 137/6416* (2015.04); *Y10T 137/7287* (2015.04); *Y10T 137/7323* (2015.04)

(58) Field of Classification Search

CPC ..... G05D 7/0676; E04B 1/7023; F04B 23/02
USPC ..... 137/565.17, 312; 52/741.3; 15/300.1–422.2

See application file for complete search history.

(56) References Cited

U.S. PATENT DOCUMENTS

| | | | | |
|---|---|---|---|---|
| 6,412,123 | B1 * | 7/2002 | Lau | A61H 33/60 4/492 |
| 8,550,110 | B2 * | 10/2013 | Trotter | E04B 1/70 137/312 |
| 9,169,636 | B2 * | 10/2015 | Blank | E04B 1/7023 |
| 2004/0088817 | A1 * | 5/2004 | Cochran | A47L 5/14 15/327.5 |
| 2006/0179601 | A1 * | 8/2006 | Crevling | A47L 5/14 15/326 |
| 2008/0040842 | A1 * | 2/2008 | Sanabria | A47K 13/307 4/213 |
| 2009/0050549 | A1 * | 2/2009 | Kerfoot | B01F 3/04262 210/139 |
| 2010/0319296 | A1 * | 12/2010 | Trotter | E04B 1/70 52/741.3 |

(Continued)

FOREIGN PATENT DOCUMENTS

| | | | | |
|---|---|---|---|---|
| EP | 2215948 | * | 8/2010 | A47L 5/36 |

OTHER PUBLICATIONS

S-Class Spa Builders Service Manual, Jul. 2005.*

*Primary Examiner* — Craig Schneider
*Assistant Examiner* — Angelisa L Hicks
(74) *Attorney, Agent, or Firm* — Plager Schack LLP

(57) ABSTRACT

A shallow fluid extractor is configured to remove a low level of a fluid from a designated area. The shallow fluid extractor includes a vacuum pump assembly further including an electrical power source connected to a vacuum and a pump. A pipe pick up assembly is configured within the designated area and connected to the vacuum pump assembly. When the low level of the fluid is reached the vacuum draws the fluid through the pipe pick up assembly into the vacuum pump assembly which is then pumped away by the vacuum pump assembly.

8 Claims, 4 Drawing Sheets

(56) References Cited

U.S. PATENT DOCUMENTS

2015/0355644 A1* 12/2015 Rau ..... G05D 7/0676
137/334

* cited by examiner

SHALLOW FLUID EXTRACTOR

RELATED APPLICATION

This application claims priority to provisional patent application U.S. Ser. No. 62/009,013 filed on Jun. 6, 2014, the entire contents of which is herein incorporated by reference.

BACKGROUND

The embodiments herein relate generally to solutions for removing fluid from a flooded area and to extract heat.

Prior to embodiments of the disclosed invention, there was no comprehensive solution for automatic shallow fluid extraction ⅛ inch depth around all area perimeters without cavitation and single location sump pickup. Systems today use one location sump basins to congregate liquid in before pumping out. This causes condensation and cavitation. Embodiments of the disclosed invention solve this problem.

SUMMARY

A shallow fluid extractor is configured to remove a low level of a fluid from a designated area. The shallow fluid extractor includes a vacuum pump assembly further including an electrical power source connected to a vacuum and a pump. A pipe pick up assembly is configured within the designated area and connected to the vacuum pump assembly. When the low level of the fluid is reached the vacuum draws the fluid through the pipe pick up assembly into the vacuum pump assembly which is then pumped away by the vacuum pump assembly

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
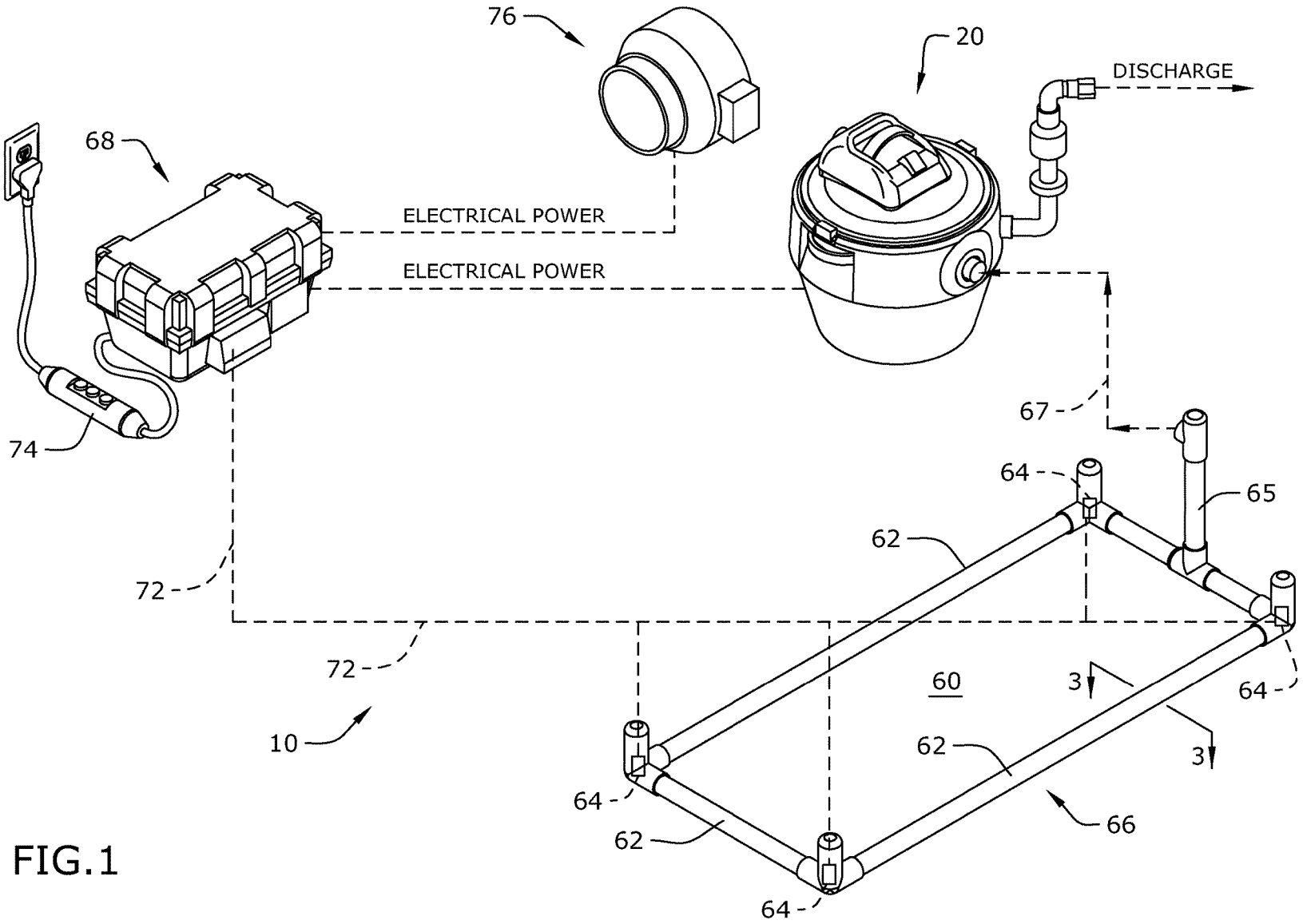
FIG. 1 is a schematic view of an embodiment of the invention.
Figure 2:
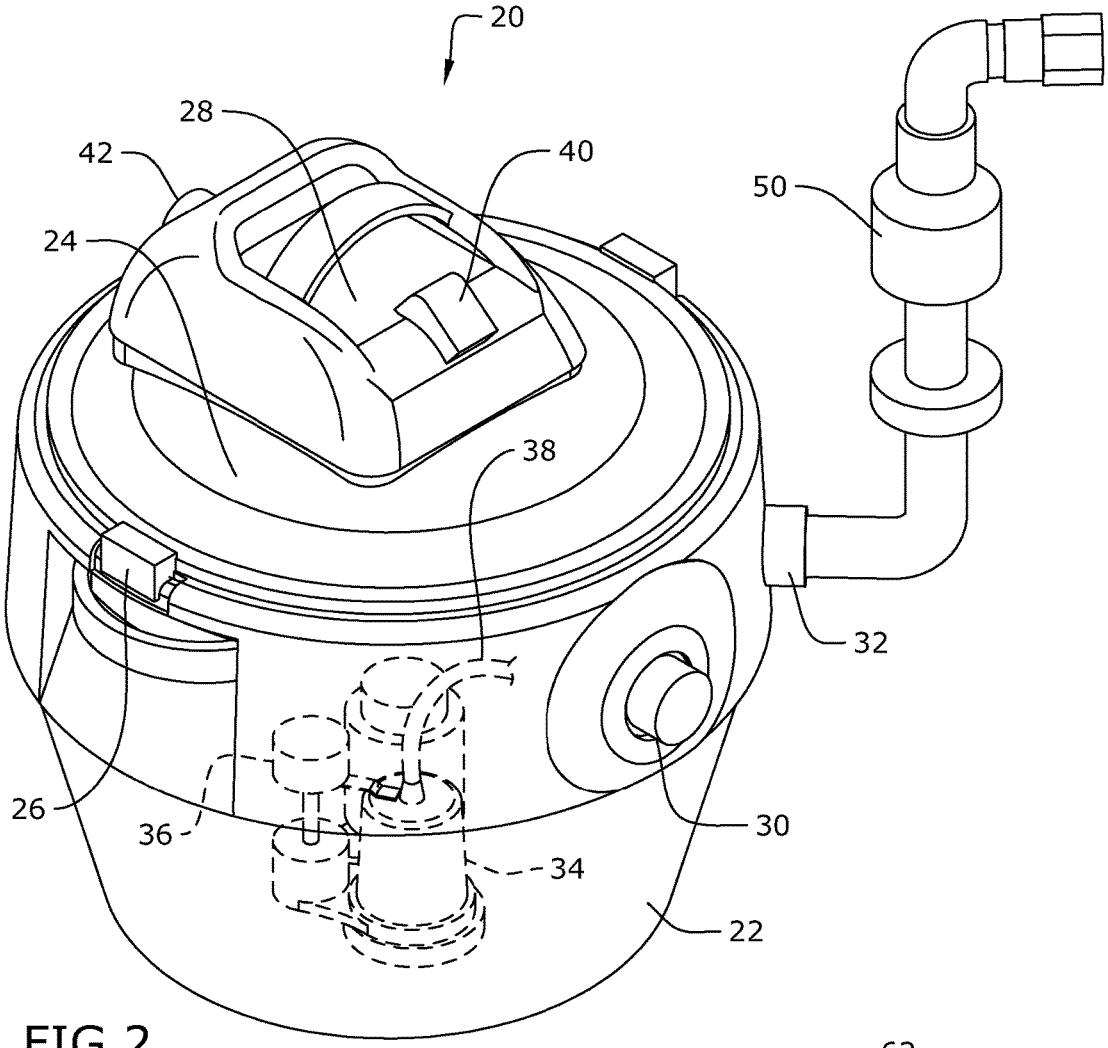
FIG. 2 is a perspective/schematic view of the VAC unit.
Figure 3:
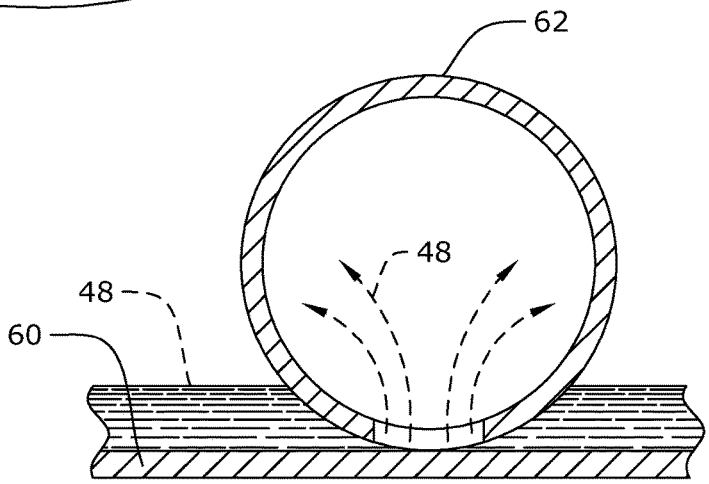
FIG. 3 is a section detail view demonstrating fluid being sucked into slotted fluid pickup pipes.

As shown in FIG. 3, a user desires to remove fluid 48 from a designated area 60. Designated area 60 is surrounded with a plurality of slotted fluid pickup pipes 62. By way of example, and referring to FIG. 1, one embodiment of shallow fluid extractor 10 comprises vacuum 20. As used in this application, a shallow fluid is a water level more than 0.125 inches but less than 1 inch, though the system could work in much deeper fluids as well.

Vacuum pump assembly 20 further comprises vacuum holding tank 22. Vacuum holding tank 22 is attached to vacuum cover 24 with vacuum cover hatch clip 26. Vacuum cover 24 is attached to vacuum motor 28. Vacuum holding tank 22 is connected to vacuum suction intake 30 and vacuum suction output 32. Vacuum motor 28 is electrically coupled to pump drive output 34. Pump drive output 34 is electrically coupled to pump float switch 36 and pump electrical power source 38. Electrical power source 38 is electrically coupled to voltage adapter 40. Voltage adapter 40 comprises a switch that can be used to toggle vacuum motor 28 to operate on either alternating current or direct current. Vacuum holding tank 22 is further attached to vacuum blower 42. Vacuum holding tank 22 is sealed. This reduces, and in some cases, eliminates the condensation and cavitation problems that can occur in unsealed systems.

In a first mode of operation, vacuum motor 28 pulls air through vacuum suction intake 30 into vacuum holding tank 22 and removes air through vacuum blower 42. Fluid pulled in through vacuum suction intake 30 collects in vacuum holding tank 22.

In a second mode of operation fluid 48 pulled in through vacuum suction intake 30 collects in vacuum holding tank 22 until pump float switch 36 is sufficiently floated to activate. At that point, pump drive output 34 engages and pumps fluid 48 through check valve 50.

The plurality of slotted fluid pickup pipes 62 form a pipe pick up assembly 66 that possesses at least one adjustable full perimeter fluid sensor 64. Pipe pick up assembly 66 is connected to vacuum suction intake 30 with vacuum suction adapter 65. In some embodiments, this can include hose 67. Each adjustable full perimeter fluid sensor 64 is communicatively coupled to controller box 68 with communication signal 72. Controller box 68 is electrically coupled to an alternating current power supply with automatic reset ground fault interrupter 74. Controller box 68 is electrically coupled to exhaust fan 76 and vacuum pump assembly 20.

Figure 4:
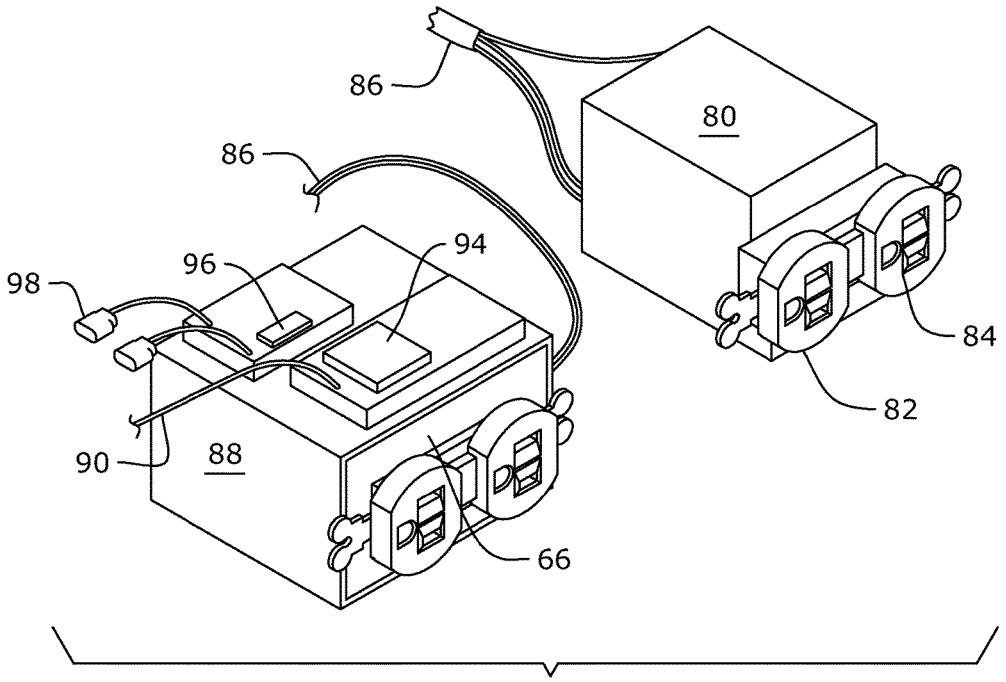
FIG. 4 is a perspective view of an embodiment of circuit components.
Figure 5:
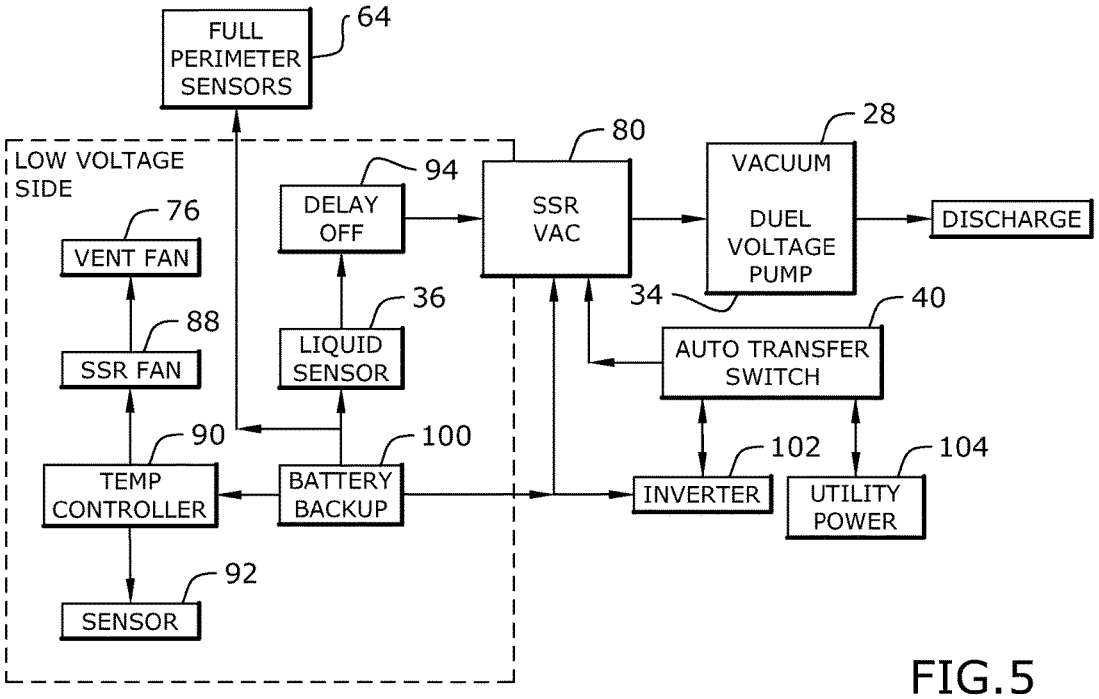
FIG. 5 is a schematic view of an embodiment of the electrical system.

FIG. 4 and FIG. 5 show this in more detail. Inside of controller box 68 is high voltage solid state relay box 80. High voltage solid state relay box 80 further comprises vacuum control plug 82 and pump control plug 84. High voltage solid state relay box 80 is connected to transfer wire 86. Transfer wire 86 is connected to low voltage solid state relay box 88. Low voltage solid state relay box 88 is electrically coupled to temperature controller 90. Temperature controller 90 is electrically coupled to temperature sensor 92. When temperature sensor 92 indicates an elevated temperature then low voltage solid state relay box 88 engages exhaust fan 76 to ventilate the space. An elevated temperature is at least 70 degrees Fahrenheit, but this can be configured to be higher depending on user preference.

Low voltage solid state relay box 88 is electrically coupled to adjustable delay 94. When toggled on, adjustable delay 94 limits the time period that high voltage solid state relay box 80 will have power, if, for instance a user does not want the system to operate at some specified time.

Low voltage solid state relay box 88 is electrically coupled to adjustable fluid sensor circuit 96. Adjustable fluid sensor circuit 96 is communicatively coupled to each adjustable full perimeter fluid sensor 64. When any adjustable full perimeter fluid sensor 64 indicates a fluid 86 level is sufficiently high, then adjustable fluid sensor circuit 96 permits electrical power to travel to high voltage solid state relay box 80. Sufficiently high can mean at least a quarter inch, but can be adjusted upward from there.

In some embodiments, low voltage solid state relay box 88 is electrically coupled to hour counter 98. Hour counter 98 enables careful monitoring of the amount of time that low voltage solid state relay box 88 or any component connected thereto is running.

As shown in FIG. 5, in some embodiments it may be advantageous to have a battery system as well to operate the high voltage components. To do this battery 100 is electrically coupled to the low voltage components and high voltage solid state relay box 80. Battery 100 is further connected to inverter 102. Inverter 102 is electrically coupled to voltage adapter 40 which is electrically coupled to vacuum motor 28 and pump drive output 34. Alternately, alternating current 104 powers the high voltage components.

Figure 6:
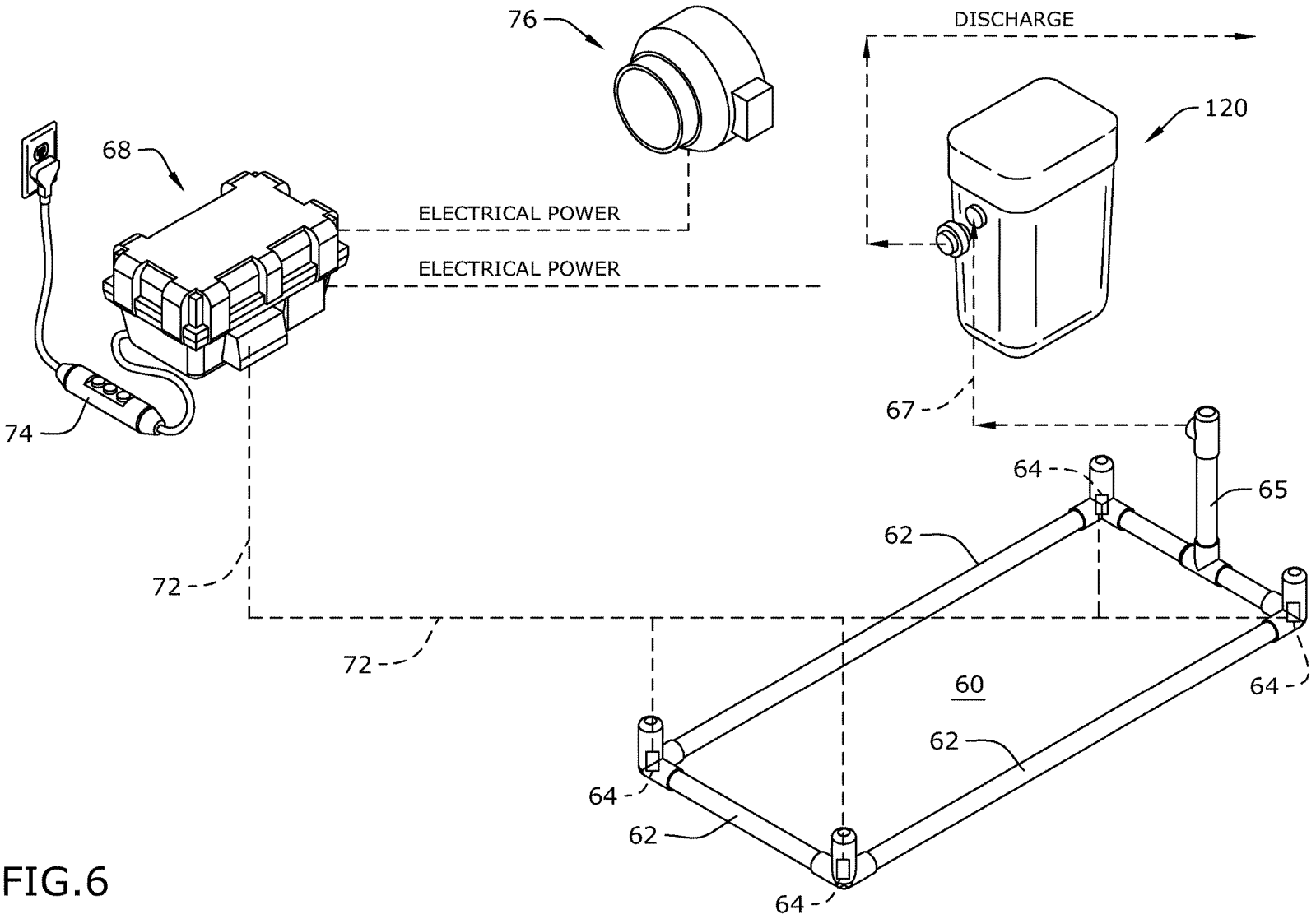
FIG. 6 is a schematic view of an embodiment of the invention

As shown in FIG. 6, in some embodiments, vacuum pump assembly 20 can either be a movable vacuum pump assembly 20 or a wall mounted vacuum pump assembly 120.

As used in this application, the term "a" or "an" means "at least one" or "one or more."

All references throughout this application, for example patent documents including issued or granted patents or equivalents, patent application publications, and non-patent literature documents or other source material, are hereby incorporated by reference herein in their entireties, as though individually incorporated by reference, to the extent each reference is at least partially not inconsistent with the disclosure in the present application (for example, a reference that is partially inconsistent is incorporated by reference except for the partially inconsistent portion of the reference).

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

Any element in a claim that does not explicitly state "means for" performing a specified function, or "step for" performing a specified function, is not to be interpreted as a "means" or "step" clause as specified in 35 U.S.C. §112, ¶6. In particular, any use of "step of" in the claims is not intended to invoke the provision of 35 U.S.C. §112, ¶6.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A shallow fluid extractor, configured to remove a low level of a fluid from a designated area; the shallow fluid extractor comprising:

a vacuum pump assembly, further comprising an electrical power source connected to a vacuum and a pump;

a pipe pick up assembly, configured within the designated area and connected to the vacuum pump assembly;

a controller box, electrically coupled to an alternating current power supply with an automatic reset ground fault interrupter; wherein the controller box is electrically coupled to an exhaust fan and the vacuum pump assembly;

a vacuum control plug electrically coupled to the vacuum; and a transfer wire;

a low voltage solid state relay box, electrically coupled to the transfer wire and further electrically coupled to a temperature controller; a temperature sensor electrically coupled to the temperature controller; wherein when the temperature sensor indicates an elevated temperature then the low voltage solid state relay box engages the exhaust fan to ventilate the designated area;

wherein when the low level of the fluid is reached in the full perimeter pipe pick up assembly the vacuum draws the fluid into in a sealed self-contained holding tank;

wherein when sufficient vacuumed fluid is accumulated in the self-contained holding tank, the vacuum pump assembly pumps away the vacuumed fluid.

2. The shallow fluid extractor of claim 1, wherein the vacuum pump assembly further comprises:

a vacuum holding tank attached to a vacuum cover with a vacuum cover hatch clip; wherein the vacuum holding tank is sealed to reduce condensation and cavitation problems;

a vacuum motor attached to the vacuum cover;

a vacuum suction intake and a vacuum suction output connected to the vacuum holding tank;

a pump drive output, electrically coupled to a pump float switch and the electrical power source a vacuum blower, attached to the vacuum holding tank;

wherein a first mode of operation, the vacuum motor pulls air through the vacuum suction intake into the vacuum holding tank and removes air through the vacuum blower such that fluid pulled in through the vacuum suction intake collects in the vacuum holding tank;

wherein a second mode of operation, the fluid that is pulled in through the vacuum suction intake collects in the vacuum holding tank until the pump float switch is activated; then the pump drive output engages and pumps the fluid away.

3. The shallow fluid extractor of claim 2, further comprising a voltage adapter electrically coupled to the electrical power source;

wherein the voltage adapter comprises a switch that is adapted to toggle the vacuum motor to operate on either alternating current or direct current.

4. The shallow fluid extractor of claim 2, wherein the pipe pick up assembly further comprises a plurality of slotted fluid pickup pipes that possesses at least one adjustable full perimeter fluid sensor.

5. The shallow fluid extractor of claim 4, further comprising a vacuum suction adapter connected to the pipe pick up assembly and the vacuum suction intake.

6. A shallow fluid extractor, configured to remove a low level of a fluid from a designated area; the shallow fluid extractor comprising:

a vacuum pump assembly, further comprising an electrical power source connected to a vacuum and a pump; wherein the vacuum pump assembly further comprises:

a vacuum holding tank attached to a vacuum cover with a vacuum cover hatch clip; wherein the vacuum holding tank is sealed to reduce condensation and cavitation problems;

a vacuum motor attached to the vacuum cover;

a vacuum suction intake and a vacuum suction output connected to the vacuum holding tank;

a pump drive output, electrically coupled to a pump float switch and the electrical power source a vacuum blower, attached to the vacuum holding tank;

wherein a first mode of operation, the vacuum motor pulls air through the vacuum suction intake into the vacuum holding tank and removes air through the vacuum blower such that fluid pulled in through the vacuum suction intake collects in the vacuum holding tank;

wherein a second mode of operation, the fluid that is pulled in through the vacuum suction intake collects in the vacuum holding tank until the pump float switch is activated; then the pump drive output engages and pumps the fluid away a pipe pick up assembly, configured within the designated area and connected to the vacuum pump assembly;

wherein when the low level of the fluid is reached in the full perimeter pipe pick up assembly the vacuum draws the fluid into in a sealed self-contained holding tank;

wherein when sufficient vacuumed fluid is accumulated in the self-contained holding tank, the vacuum pump assembly pumps away the vacuumed fluid;

a plurality of slotted fluid pickup pipes that possesses at least one adjustable full perimeter fluid sensor;

a controller box, electrically coupled to an alternating current power supply with an automatic reset ground fault interrupter; wherein the controller box is electrically coupled to an exhaust fan and the vacuum pump assembly;

a high voltage solid state relay box that further comprises: a vacuum control plug electrically coupled to the vacuum motor and a pump control plug electrically coupled to the pump drive output; and a transfer wire;

a low voltage solid state relay box, electrically coupled to the transfer wire and further electrically coupled to a temperature controller; a temperature sensor electrically coupled to the temperature controller; wherein when the temperature sensor indicates an elevated temperature then the low voltage solid state relay box engages the exhaust fan to ventilate the designated area.

7. The shallow fluid extractor of claim 6, further comprising an adjustable delay, electrically coupled to the low voltage solid state relay box; wherein the adjustable delay is adapted to limit a time period that the high voltage solid state relay box will have power.

8. The shallow fluid extractor of claim 7, further comprising an adjustable fluid sensor circuit electrically coupled to the low voltage solid state relay box; wherein the adjustable fluid sensor circuit is communicatively coupled to each adjustable full perimeter fluid sensor; wherein when any adjustable full perimeter fluid sensor indicates a fluid level that is sufficiently high, then the adjustable fluid sensor circuit enables electrical power to travel to the high voltage solid state relay box.

* * * * *